US007108330B2

(12) United States Patent
Mizelle et al.

(10) Patent No.: US 7,108,330 B2
(45) Date of Patent: Sep. 19, 2006

(54) PORTABLE CHAIR

(75) Inventors: Ned W. Mizelle, High Point, NC (US); Shay Shalmon, Northbrook, IL (US)

(73) Assignee: Greenwich Industries, L.P., Lake Bluff, IL (US)

( * ) Notice: Subject to any disclaimer, the term of this patent is extended or adjusted under 35 U.S.C. 154(b) by 0 days.

(21) Appl. No.: 10/625,370

(22) Filed: Jul. 23, 2003

(65) Prior Publication Data

US 2005/0017554 A1 Jan. 27, 2005

(51) Int. Cl.
*A47C 7/02* (2006.01)
*A47C 31/00* (2006.01)

(52) U.S. Cl. ..... 297/452.57; 297/218.1; 297/219.1; 297/228.1

(58) Field of Classification Search ..... 297/452.18, 297/447.2, 452.55, 452.56, 452.57, 440.21, 297/440.22, 218.1, 228.1, 219.1
See application file for complete search history.

(56) References Cited

U.S. PATENT DOCUMENTS

| | | | | |
|---|---|---|---|---|
| D153,735 | S | 5/1949 | Staudt et al. | |
| 2,934,134 | A * | 4/1960 | Adler | 160/371 |
| D192,419 | S | 3/1962 | Sullivan | |
| 3,367,392 | A * | 2/1968 | Green | 160/371 |
| D218,028 | S | 7/1970 | Lohr | |
| 3,531,552 | A | 9/1970 | Getz et al. | |
| 4,057,291 | A * | 11/1977 | Dubinsky | 297/440.11 |
| 4,273,379 | A * | 6/1981 | Borichevsky | 297/56 |
| 4,685,738 | A * | 8/1987 | Tinus | 297/452.56 |
| 4,723,816 | A * | 2/1988 | Selbert et al. | 297/452.56 |
| 4,842,257 | A * | 6/1989 | Abu-Isa et al. | 267/133 |
| 4,861,104 | A * | 8/1989 | Malak | 297/218.3 |
| 5,375,914 | A * | 12/1994 | Donnelly | 297/335 |
| 5,393,126 | A * | 2/1995 | Boulva | 297/452.56 |
| D355,986 | S | 3/1995 | Myers | |
| D355,999 | S | 3/1995 | Townsend | |
| 5,609,395 | A * | 3/1997 | Burch | 297/452.55 |
| D386,036 | S | 11/1997 | Laidlaw | |
| 5,887,942 | A * | 3/1999 | Allegro, Jr. | 297/188.12 |
| D413,029 | S | 8/1999 | Caruso | |
| D414,349 | S | 9/1999 | Jenkins et al. | |
| D414,951 | S | 10/1999 | Breen | |

(Continued)

FOREIGN PATENT DOCUMENTS

GB 2201088 A * 8/1988

OTHER PUBLICATIONS

"High Performance Elastic Webbing for Residential & Commercial Seating," *Ultraflex*, Article, 10 pages.

*Primary Examiner*—Peter M. Cuomo
*Assistant Examiner*—Sarah B. McPartlin
(74) *Attorney, Agent, or Firm*—Fitch, Even, Tabin & Flannery

(57) ABSTRACT

There is provided a portable, folding chair with an enhanced seat and backrest. The seat includes a suspension system that is capable of providing an enhanced range of motion in seating directions. The backrest provides enhanced support through an enlarged support surface and improved disposition of the support surface relative to the chair frame. The seat and backrest can be used together on the same chair or independently. There is also provided an alternate seat employing a suspension system that is capable of providing an enhanced range of motion in seating directions and that has a low profile to be used in situations where storage space is a significant consideration.

4 Claims, 10 Drawing Sheets

U.S. PATENT DOCUMENTS 6,010,195 A * 1/2000 Masters et al. ..... 297/452.55
D420,538 S 2/2000 Arko et al.
D421,861 S 3/2000 Ginat
6,106,071 A * 8/2000 Aebischer et al. ..... 297/452.18
D434,252 S 11/2000 Turner et al.
6,174,029 B1 * 1/2001 Swy ..... 297/448.1
D439,070 S 3/2001 Turner et al.
6,199,252 B1 * 3/2001 Masters et al. ..... 29/91.1
D463,173 S 9/2002 Chi
6,612,652 B1 * 9/2003 Tenenboym et al. ..... 297/354.1
6,709,050 B1 * 3/2004 Huang ..... 297/57
6,848,746 B1 * 2/2005 Gentry ..... 297/380

* cited by examiner

PORTABLE CHAIR

FIELD OF THE INVENTION

The present invention relates generally to portable chairs and, more particularly, to portable, folding chairs having a durable and sturdy construction adapted for heavy use and providing enhanced structural features to facilitate comfort, use and storage.

BACKGROUND OF THE INVENTION

In the portable seating industry, a market exists for high performance folding chairs that are capable of efficiently and effectively withstanding heavy use and servicing large audiences. These seating situations are commonly found in gymnasiums, stadiums, auditoriums, schools and churches and at outdoor events, such as picnics and concerts. Due to the common nature of the events, the performance requirements for these chairs can be extremely demanding. For example, they must be able to withstand rugged use, such as that commonly found with sports fans and concert goers, and to also provide comfort for long seating periods.

Many folding chairs tend be uncomfortable, especially in circumstances of extended seating time. For example, seats are commonly made of a rigid material, such as metal, plastic or wood, which obviously can become uncomfortable over time. Sometimes these rigid seats are covered with a layer of padding, such as foam, which may not be sufficient in thickness, resiliency and/or quality in every case.

Moreover, these seat constructions tend to ignore the contours of the human body. For example, seating surfaces are commonly one dimensional, whereas the human body plainly is not so simple.

Folding chairs also tend to provide insufficient back support for the reason that the back support is commonly minimized for folding operation and storage. For instance, backrest portions are typically much smaller than the human back and also are made of a rigid material, such as metal, plastic or wood, which obviously can become uncomfortable over time, and ignores the contours of the human body. As with seats, backrests are sometimes covered with a layer of padding, such as foam, which may not be sufficient in every case. Also, backrests tend to be one-dimensional, as opposed to the human body. As a result, there is desire for a folding chair with a seat and backrest that provide enhanced comfort, particularly for high performance folding chairs used in preferred seating areas, and also the requisite durability for heavy and rugged use.

In addition to providing an enhanced folding chair, there is also a desire for a folding chair that provides enhanced seat comfort but remains lightweight and compact. In order to improve seating comfort, seats are commonly provided with additional padding, which, as a result, causes the overall thickness of the chair in the storage configuration to be too thick for many cases. That is, in some instances, storage for chairs is a significant consideration, and thus, these situations require a relatively thin chair to facilitate storage. However, there is a desire for a chair that provides a seat having more comfort than traditional metal or wood seats simply covered with a layer of foam that also can be stored in approximately the same space as such traditional chairs.

DETAILED DESCRIPTION OF THE PREFERRED EMBODIMENTS

Figure 1:
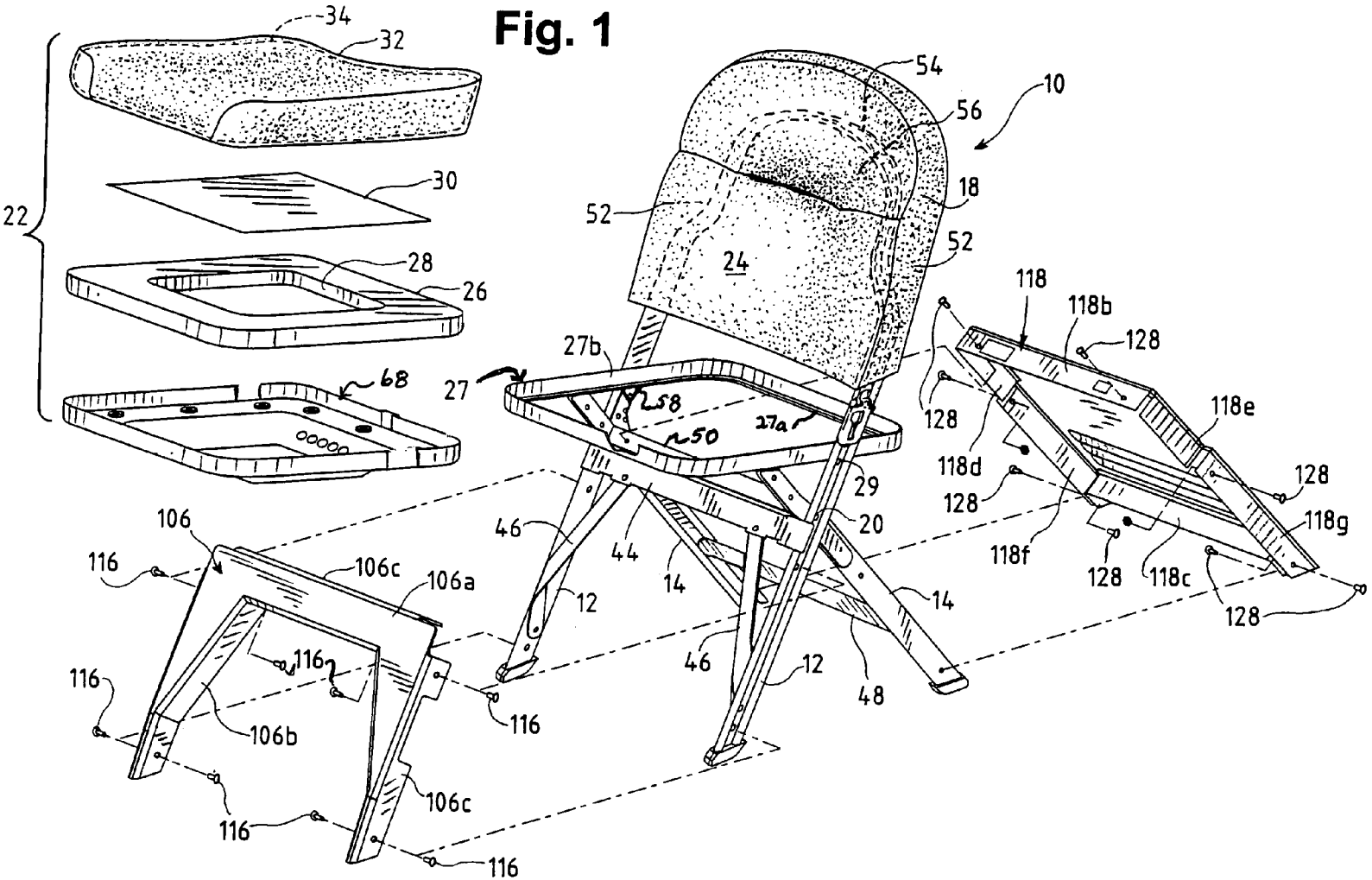
FIG. 1 is a partially exploded, partial perspective view of a folding chair embodying features of the present invention.
Figure 2:
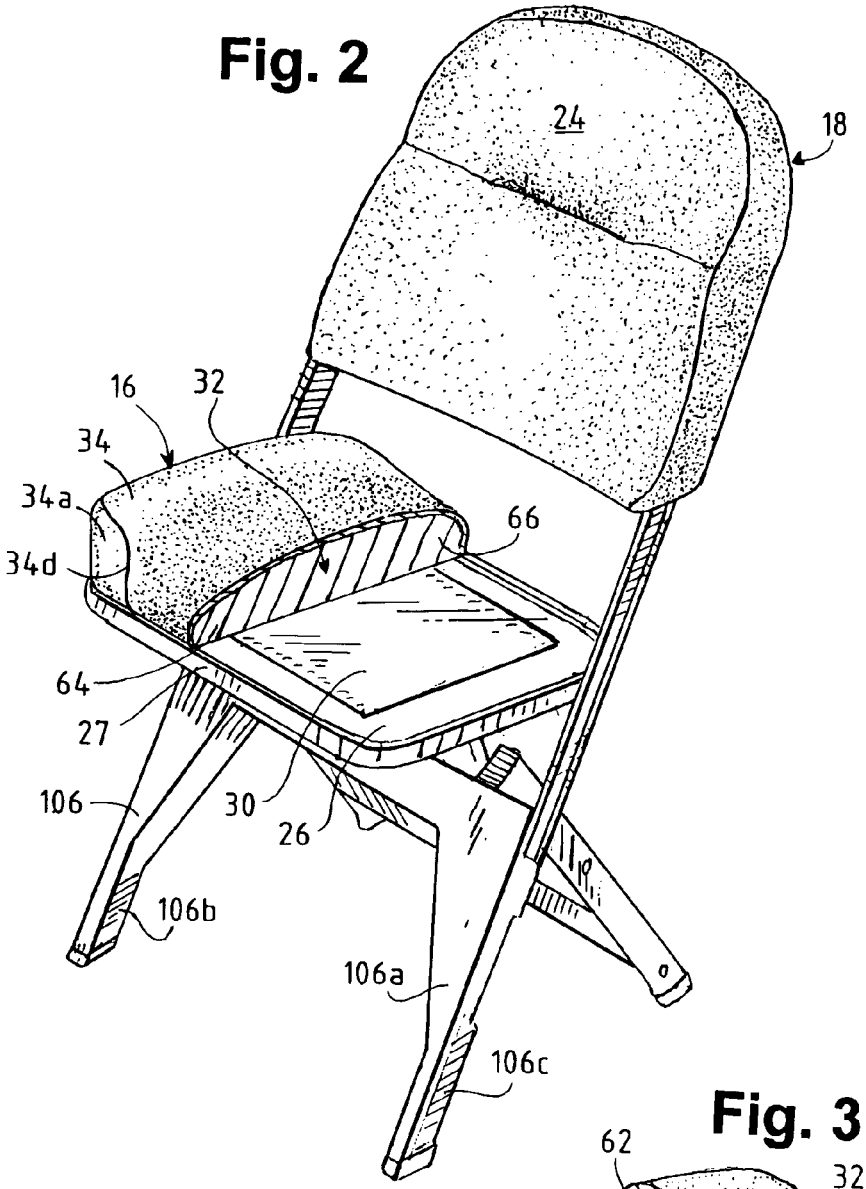
FIG. 2 is a perspective view of the chair of FIG. 1 with a portion of the seat cut away to expose various layers of the seat construction.
Figure 3:
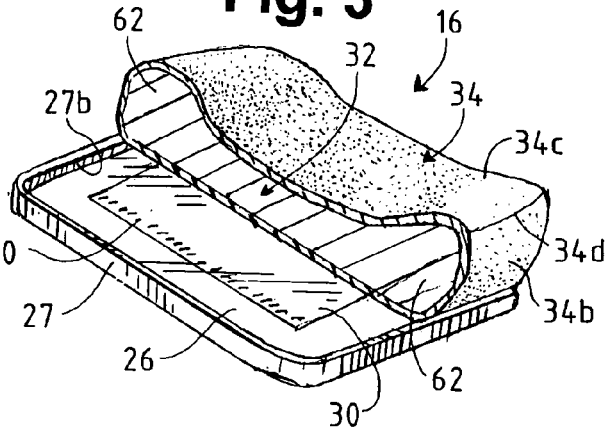
FIG. 3 is a perspective view of the seat of the chair of FIG. 2 with a different portion of the seat cut away to expose various layers of the seat construction.
Figure 4:
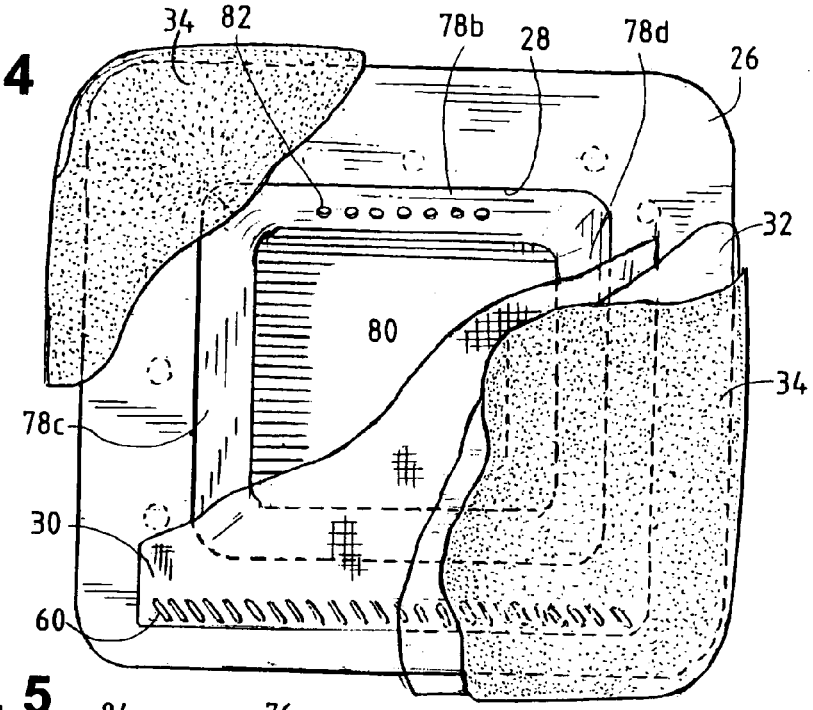
FIG. 4 is a plan view of the seat of the chair of FIG. 2 and the seat of FIG. 3 with various portions cut away to expose various layers of the seat construction.
Figure 5:
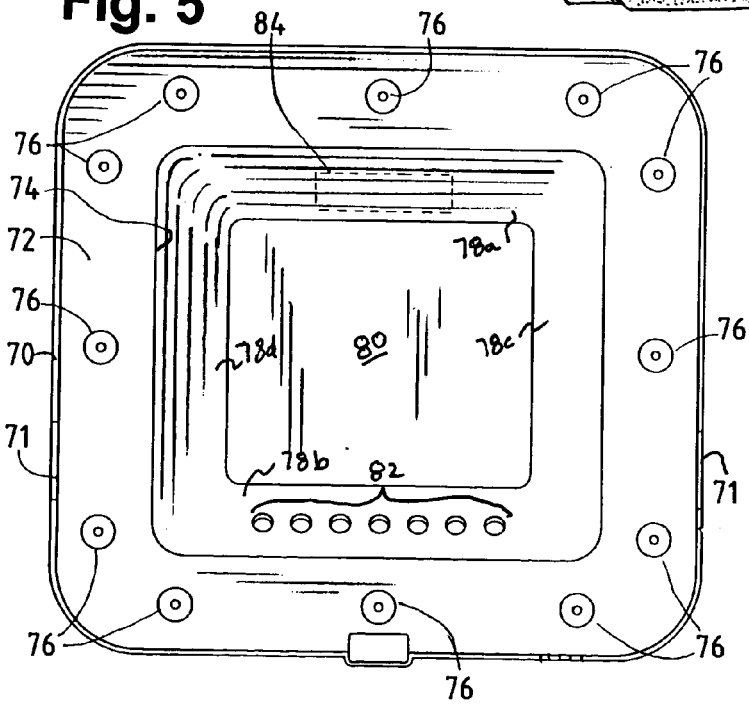
FIG. 5 is a plan view of a bottom cover of the seat of FIG. 4.
Figure 6:
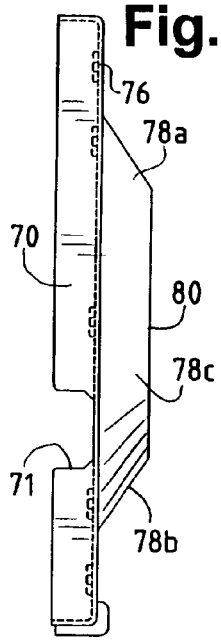
FIG. 6 is a side elevational view of the bottom cover of FIG. 5.
Figure 7:
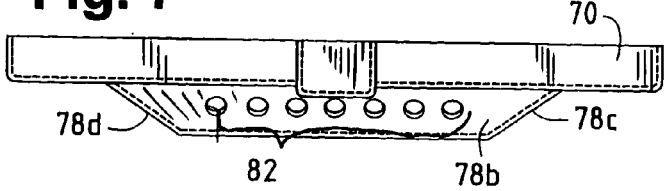
FIG. 7 is a rear elevational view of the bottom cover of FIG. 5.
Figure 8:
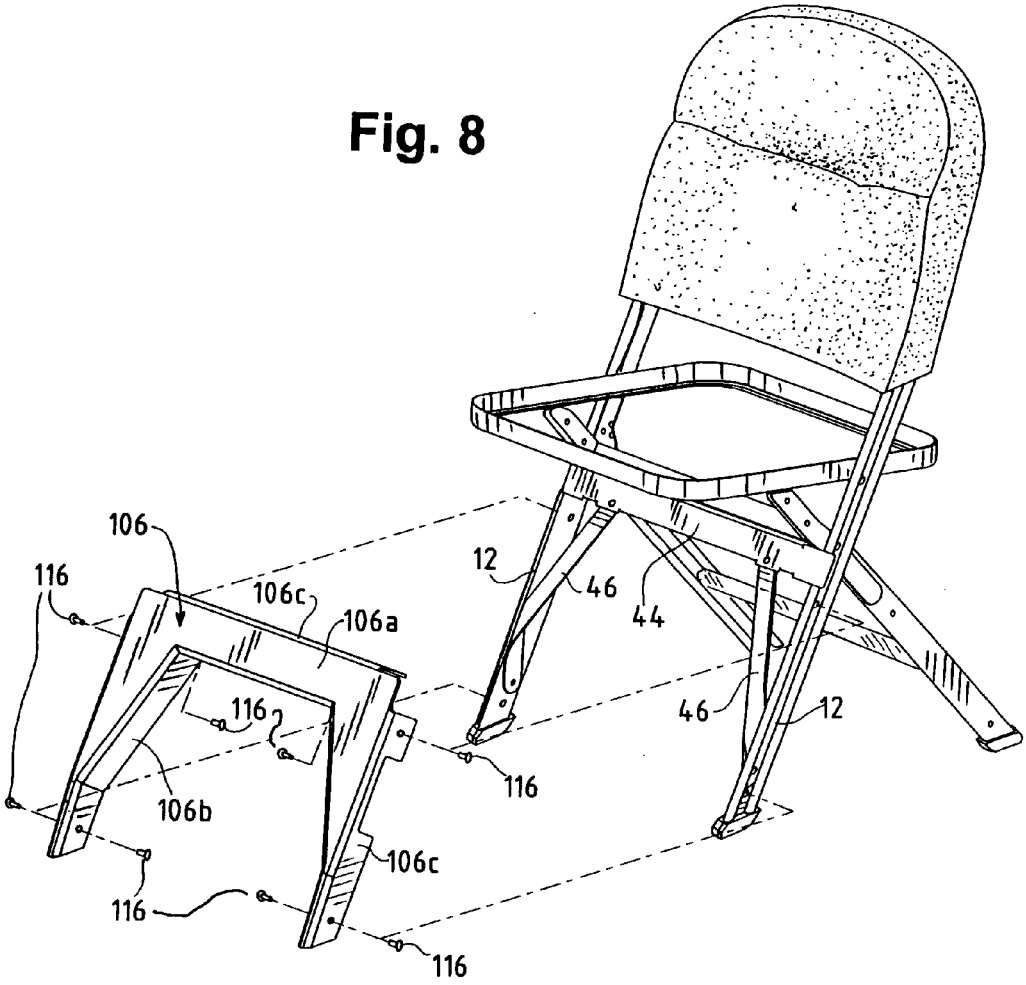
FIG. 8 is a partially exploded, perspective view of the chair of FIG. 2 with the seat removed to illustrate attachment of a cover for the front legs.
Figure 9:
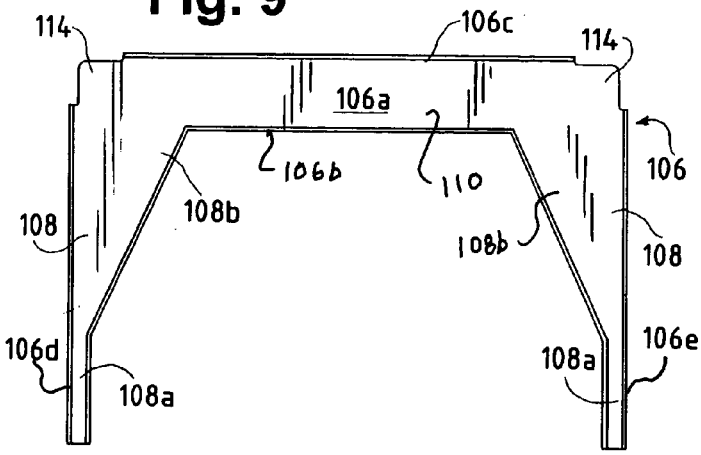
FIG. 9 is a rear elevational view of the cover in FIG. 8 for the front legs.
Figure 10:
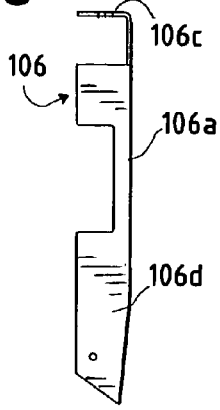
FIG. 10 is a side elevational view of the cover in FIG. 8 for the front legs.
Figure 11:
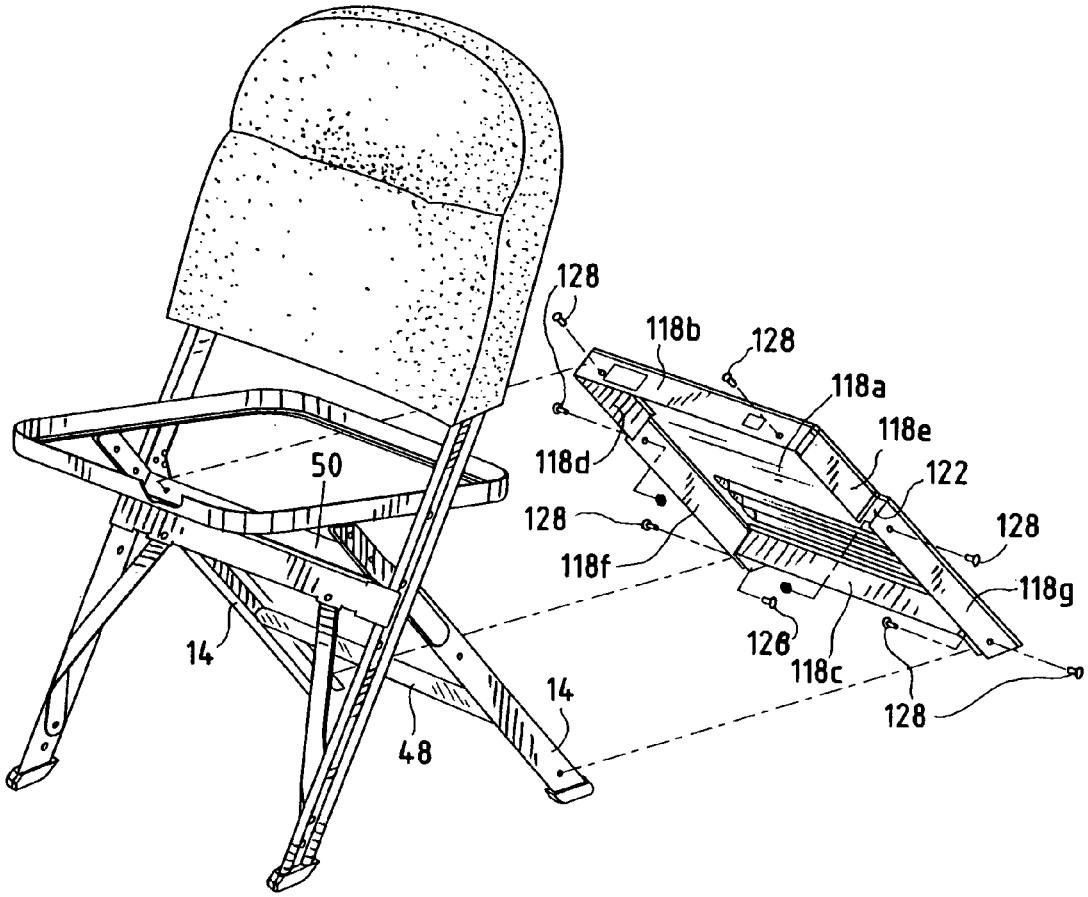
FIG. 11 is a partially exploded, perspective view of the chair of FIG. 2 with the seat removed to illustrate attachment of a cover for the rear legs.
Figure 12:
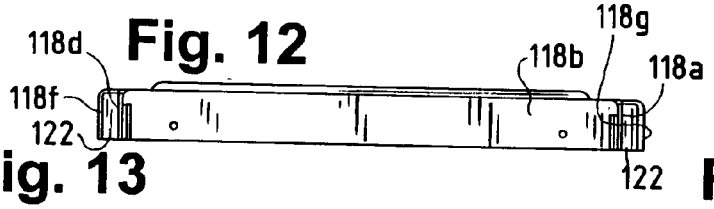
FIG. 12 is an elevational view of the top of the cover in FIG. 11 for the rear legs.
Figure 13:
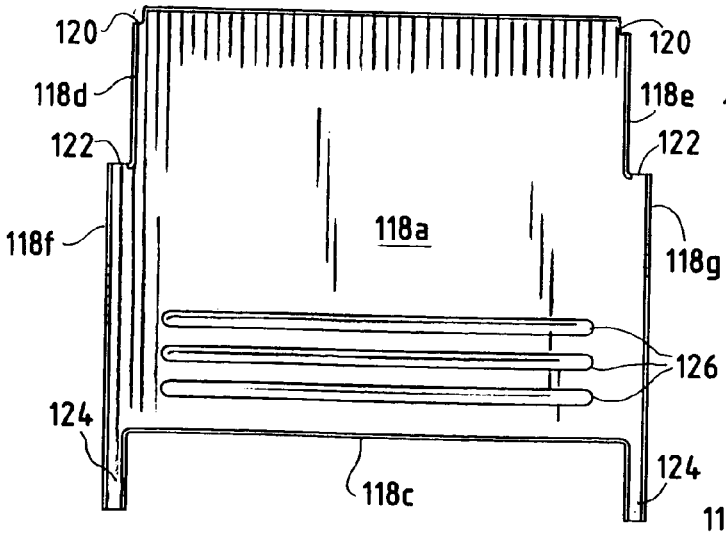
FIG. 13 is a plan view of the inside of the cover of FIG. 11 for the rear legs.
Figure 14:
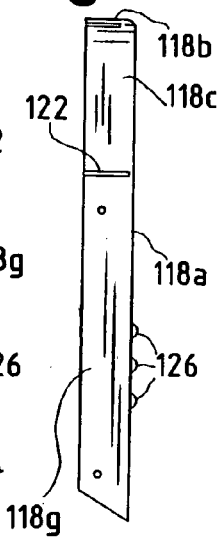
FIG. 14 is a side elevational view of the cover of FIG. 11 for the rear legs.

Referring to FIGS. 1–3, there is illustrated a portable, folding chair 10 embodying features of the present inventions. The chair 10 includes a set of front legs 12 that extend from the ground rearwardly and upwardly, and a set of rear legs 14 that extend from the ground forwardly and upwardly. The sets of front and rear legs 12, 14 support a seat 16, and the set of front legs 12 extend rearwardly upwards beyond the seat 16 to support a backrest 18. At each side of the chair 10, one of the front legs 12 and one of the rear legs 14 are joined with a pivot attachment 20 in an X-like manner to from an X-shaped frame. With the X-shaped frame, the chair 10 is able to accommodate a range of uneven surfaces in a manner where each of the legs 12, 14 stays in contact with the ground. To further enhance the comfort of the chair 10, the seat 16 includes an enhanced suspension system 22, and the backrest 18 provides improved support through an enlarged support surface 24 and improved disposition of the support surface 24 relative to the chair frame.

As discussed in further detail infra, the suspension systems 22 includes a multi-layer structure designed to provide an enhanced range of motion for the seat 16, particularly in the vertical direction. More specifically, a suspension support frame 26 defines a central opening 28, which is covered with an elastic webbing 30. The webbing 30 supports a layer of foam 32, and a soft cover 34 overlies the foam 32. The webbing 30 provides the seat with enhanced relief in the generally downward vertical direction beyond a seat frame 27. The seat frame 27 supports the suspension system 22 in the chair 10 and is attached to the rear legs 12 with a pivot attachment 29.

The backrest 18 also includes a multi-layer structure that provides enhanced back support through the enlarged support surface area 24 and an enhanced angle of contact with the occupant's back. As illustrated in FIGS. 15–20, the backrest 18 includes a front clamshell member 36 and a rear clamshell member 38. The clamshell members 36, 38 are closed about most of the frame portion extending upward beyond the seat 16. The clamshell members 36, 38 enlarge the surface area of the backrest and are preferably angled slightly forward relative to the supporting portion of the frame. This forward angle aids to position the back in a more upright position. A foam layer 40 molded in the form of a sleeve extends over the assembled clamshell members 36, 38. The foam layer 40 has varying thickness designed to provide more comfort in predetermined areas. A flexible cover 42 in the form of a sleeve overlies the foam layer 40.

Returning to FIGS. 1 and 2, the pivot attachment 20 enables the front legs 12 and the rear legs 14 to move between a use position and a storage position. In the use position, the lower ends of the front and rear legs 12, 14 are spaced from one another, and the frame takes on its X-like frame configuration. In the storage position, the legs 12, 14 are shifted such that they are generally parallel to each other. The legs 12, 14 are preferably made to have a double tube and channel cross-section to enhance overall strength of the chair 10.

A first transverse frame member 44 located immediately below the pivot attachment 20 interconnects the front legs 12, and a short frame member 46 extends downwardly and outwardly from the first transverse frame member 44 to the front leg portion located above the lower end of each of the front legs 12.

A second transverse frame member 48 extends between the rear legs 14 intermediate the lower ends of the rear legs 14 and the pivot attachment 20. A third transverse frame member 50 extend between the rear legs 14 adjacent the upper ends of the rear legs 14. Each of the upper ends of rear legs 14 can be enlarged to provide a larger support for the underside of seat 16 in the use position. The portions 52 of the front legs 12 extending upward beyond the seat 16 form an upper arcuate segment 54 across the top of the chair frame. A panel 56 extends between the upper portions 52 of the front legs 12 and around the inside of the upper arcuate segment 54.

The seat 16 pivots about the pivot attachment 29 independently of the rear and front legs 12, 14 between a horizontal, seating position and an upright position to provide additional space for walking between rows of chairs or for storage. A bracket 58 preferably is used to attach the seat frame 27 to the front legs 12 at the pivot attachment 29. The bracket 58 preferably is in the shape of triangle with two points fixedly attached to the seat frame 27 and the third point defining a hole used to attach to the front legs 12 with the second pivot attachment 29.

Additionally, the seat 16 can be biased to aid in returning (or, in some cases, to automatically return) the seat 16 to its upright orientation. More specifically, a spring (not shown), such as a helical spring, can be interconnected between one of the brackets 58 and to one of the rear chair legs 14. A spring can be located at both brackets 58 if desired. In order to provide upward rotation, the spring is located rear of the pivot attachment 29. From this reward, off-center location, the spring pulls down on the seat frame 27, thereby causing the seat frame 27 to rotate to its upright orientation.

Referring to FIGS. 1–4, the seat frame 27 supports the planar suspension support 26. The planar support 26 defines the central opening 28, which, as illustrated, can be rectangular but, also, can be of any shape. The seat frame 27 includes an inward projecting ledge 27*a* that supports the planar suspension support 26 and an upward projecting wall 27*b* to prohibit lateral movement of the suspension support 26. The planar suspension support 26 can be made of any durable material, such as metal, plastic or wood.

The elastic webbing 30 is stretched over the central opening 28 and fixed in place to the planar suspension support 26 adjacent the perimeter of the opening 28 by glue or any conventional fastener, such as staples, nails, tacks, screws, etc. As illustrated, staples 60 are used to secure the elastic webbing 30. The preferred webbing 30 can be stretched or pre-tensioned over the opening 28 to provide the desired amount of tension to control the amount of suspension in the suspension system 22. The webbing 30 enables the seat 16 to have relief in the downward vertical direction beyond the seat frame 27. For example, the preferred amount of pretension is obtained from a 15% stretch of the elastic webbing 30 during assembly. The preferred webbing can be obtained from Ultraflex of High Point, N.C.

The elastic webbing 30 supports the foam pad layer 32. The foam pad 32 has a predetermined upper contour consisting of a pair of parallel bolsters 62 along the left and right sides. The front center region 64 between the bolsters 62 is shaped to fall downward, such as a waterfall, and the rear center region 66 is shaped to taper downward similar to the front center region 64. The foam pad 32 is preferably molded with a density of 3.5 pounds per cubic feet.

The soft cover 34 has the same shape as the upper, sides and rear surfaces of the foam pad 32. The cover 34 is fitted snugly over the foam pad 32 and secured to the planar suspension support 26 with glue or any conventional fastener, such as staples, nails, tacks, screws, etc. The cover 34 is preferably formed from multi-pieces of material, such as side pieces 34*a*, 34*b* and a top piece 34*c*, that are fastened together, such as by conventional stitching 34*d*. When stitching is employed, it is preferably done in a conventional manner that provides a high-end tailored appearance. In addition, the cover material can be of any type desired, such as leather, canvas or other fabric.

Referring to FIGS. 1 and 4–7, the underside of the seat 16 is provided with a bottom cover 68 to protect against damage to the suspension system 22 and to facilitate easier cleaning of the chair. The bottom cover 68 preferably is a rigid structure. At the top, the bottom cover 68 includes an upstanding flange 70 about its generally rectangular perimeter. The dimensions preferably correspond to the dimensions of the suspension support 26 of the suspension system 22 so as to cover the entire underside of the seat 16. The flange 70 also defines a pair of cut outs 71 to accommodate the operation of the pivot attachment 29 for the seat frame 27. A planer wall portion 72 extends inward from the flange 70 to define a generally rectangular opening 74. The planar wall portion 72 defines a number of spaced apart apertures 76, which are used to mount the bottom cover 68 to the underside the suspension support 26. For example, any conventional fastener, such as screws, nut/bolt combinations, etc., can be inserted through the holes and secured to the suspension support 26.

The bottom cover 68 also includes a front, rear and side walls 78*a*, 78*b*, 78*d*, 78*c*, respectively, extending inwardly and downwardly from the planar wall portion 72 to a bottom wall 80 to define a cavity of sufficient depth to provide sufficient operating room for the suspension system 22. The cavity generally depends under the opening of the suspension support 26. The bottom cover 68 defines a number of passage or vents 82 that allow air to escape or enter the cavity as needed during use of the seat 16. For instance, when someone sits down on the seat 16, the vents 82 allow air to escape the cavity. In apposite, when someone stands up, the vents 82 allow air to be drawn in to the cavity as the elastic webbing 30 returns to its installed state and the foam 32 expands to its normal, uncompressed configuration. The preferred vents 82 consists of a number of circular holes defined by the rear wall 78*b* of the bottom cover 68. The exterior of the bottom cover also can be used to mount indicia 84, such as seat number and/or location. More specifically, the indica can be placed on the outer surface of the front wall 78*a* so that when the seat 16 is in the up position, it can be readily viewed. The bottom cover can be made of any suitably rigid material, including plastic, such as ABS ⅛-inch thick nominal.

Referring to FIGS. 15–20, the backrest 18 includes the front clamshell member 36 to enlarge the support surface 24 for the chair occupant's back. The front clamshell member 36 is symmetric about its longitudinally extending center axis. More specifically, the front clamshell member 36 consists of a wall 86 with an outer perimeter edge defined by an upper generally arcuate edge 86*a*, a lower edge 86*b* and a pair of side edges 86*d*, 86*e* extending between the upper and lower edges 86*a*, 86*b*. A flange 88 extends generally perpendicularly from the wall 88 along the upper and sides edges 86*a*, 86*c*, 86*d*. The width of the flange 88 is reduced at the lower portion of the side edges 86*c*, 86*d* to allow a portion of the frame near the seat 16 to extend from the clamshell member 36. This construction enables the chairs to be positioned flush with one another for ganging purposes (i.e., chairs attached to one another in series). The flange 88 defines a number of spaced holes 90 used to attach the front clamshell member together to the portion 52 of the front legs 12 extending beyond the seat 16 and forming the upper arcuate segment 54 (see FIG. 1). For instance, any conventional fastener, such as screws, rivets, etc., may be extended through the holes 90 and into holes defined in the upper portion 52 of the front legs 12 and the upper arcuate segment 54.

The wall 86 is gradually concave and includes a lower arcuate region 86*e* that tapers and curves inward. This contour facilitates using thicker foam at the center portion of the backrest and provides relief for the lower portion of an occupant's back. The wall 86 also defines a number of spaced holes 92 used to mount the front clamshell member 36. For instance, any conventional fastener, such as screws, rivets, etc., may be extended through the holes 92 and into holes defined in the panel 56 that extends between the upper portion 52 of the front legs 12 and around the inside of the upper arcuate segment 56.

The rear clamshell member 38 includes a wall 94 with an outer perimeter edge defined by an upper and lower generally arcuate edges 94*a*, 94*b* and a pair of side edges 94*c*, 94*d* extending between the upper and lower edges 94*a*, 94*b*. A flange 96 extends generally perpendicularly from the wall 94 at its perimeter at the upper and sides edges 94*a*, 94*c*, 94*d*. The width of the flange 96 is reduced at the lower portion of the side edges 94*c*, 94*d* to allow a portion of the frame near the seat 16 to extend from the rear claim shell member 38. This construction enables the chairs to be positioned flush with one another for ganging together (i.e., chairs attached to one another in series). The flange 96 defines a number of spaced holes 98 used to attach the rear clamshell member 38 to the portion 52 of the front legs 12 extending beyond the seat 16 and forming the upper arcuate segment 54. The wall 94 is gradually convex. The rear clamshell member 38 is symmetric about its longitudinally extending center axis.

Figure 15:
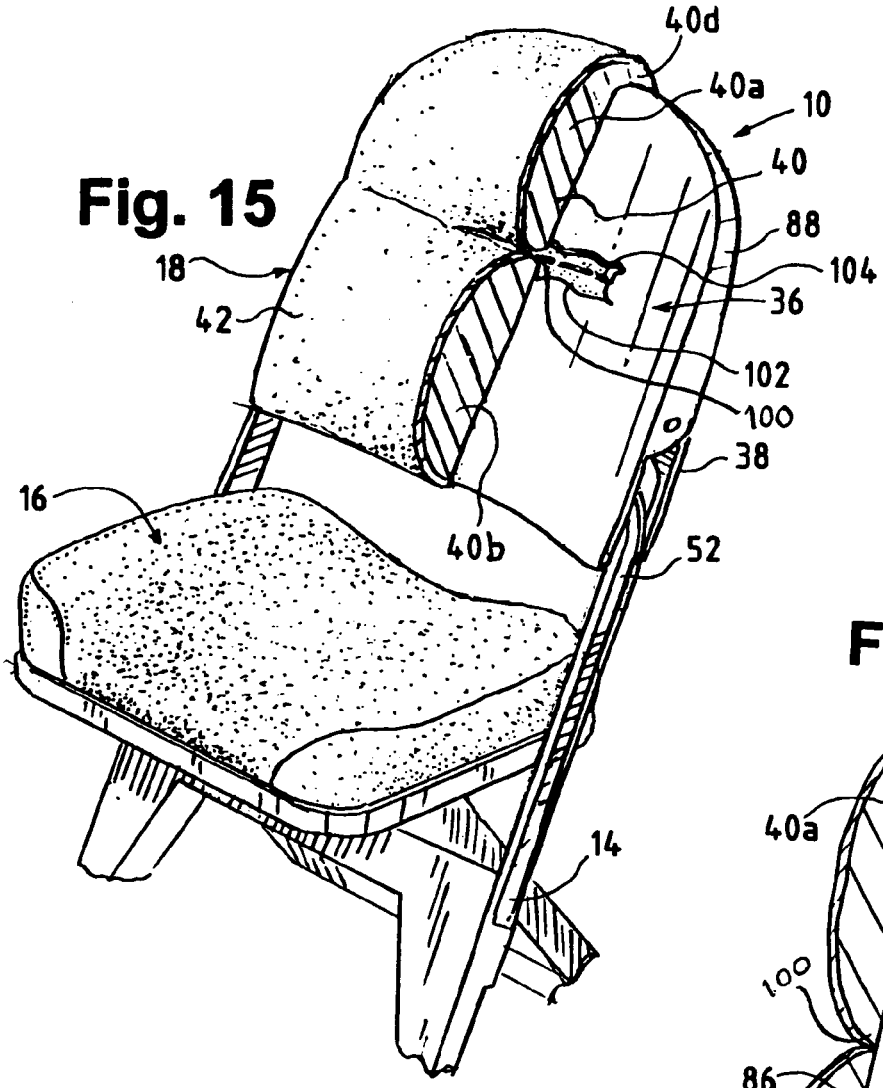
FIG. 15 is a partial perspective view of the chair of FIG. 2 with the backrest cut away to expose various layers of the backrest construction.
Figure 16:
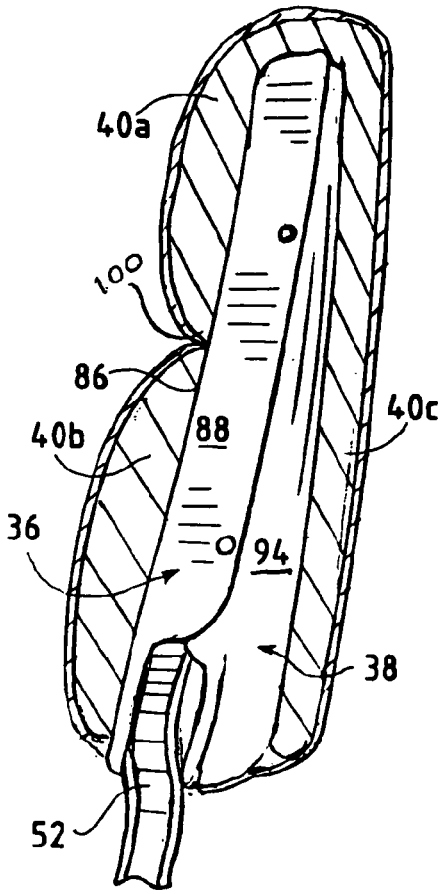
FIG. 16 is a side elevational view of the backrest in FIG. 2 with a portion of the backrest cut away to expose various layers of the backrest construction.
Figure 17:
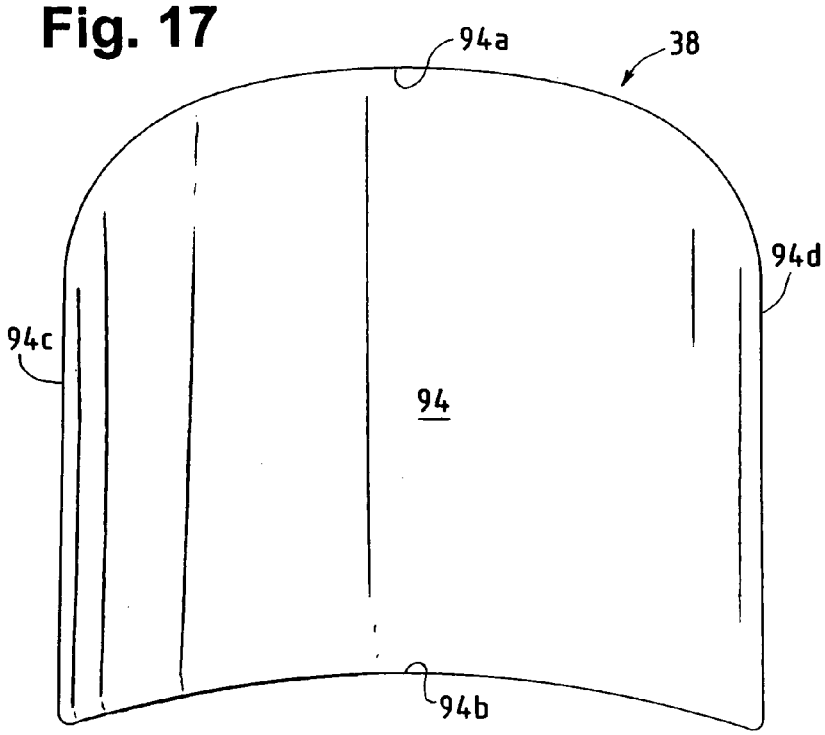
FIG. 17 is a plan view of the outside of a front clamshell member of the backrest in FIG. 2.
Figure 18:
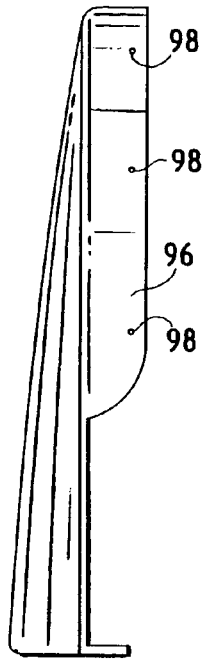
FIG. 18 is a side elevational view of the front clamshell member of the FIG. 17.
Figure 19:
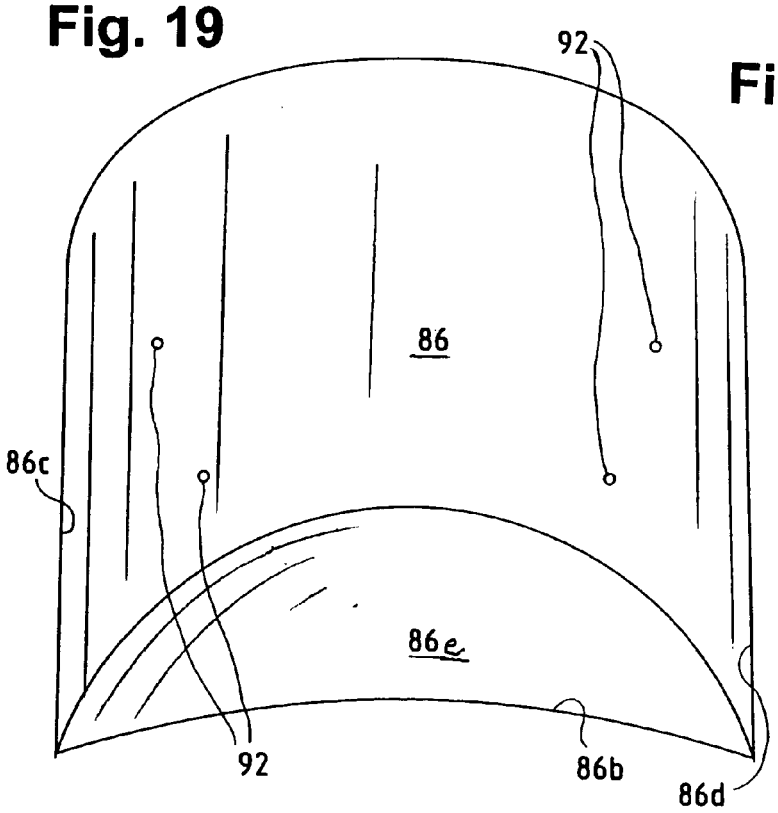
FIG. 19 is a plan view of the outside of a rear clamshell member of the backrest in FIG. 2.
Figure 20:
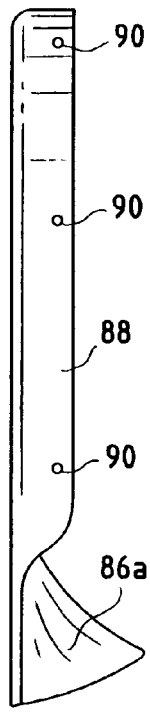
FIG. 20 is a side elevational view of the rear clamshell member of FIG. 19.
Figure 21:
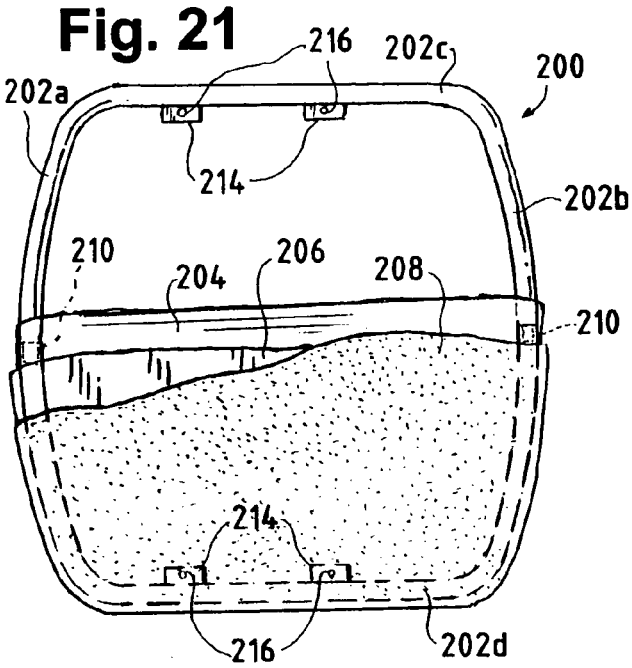
FIG. 21 is a plan view of another seat embodying features of the present invention with a portion cut away to illustrate various layers of the seat construction.
Figure 22:
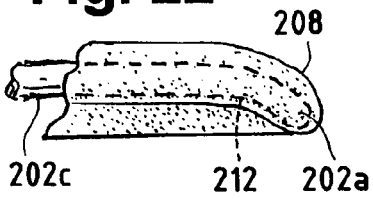
FIG. 22 is a partial side elevational view of the seat of FIG. 21.
Figure 23:
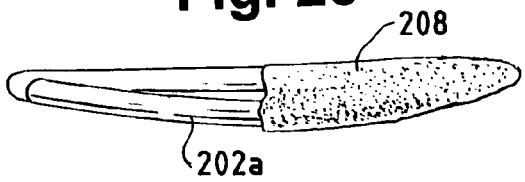
FIG. 23 is a front elevational view of the seat of FIG. 21 with a different portion cut away to illustrate various layers of the seat construction.
Figure 24:
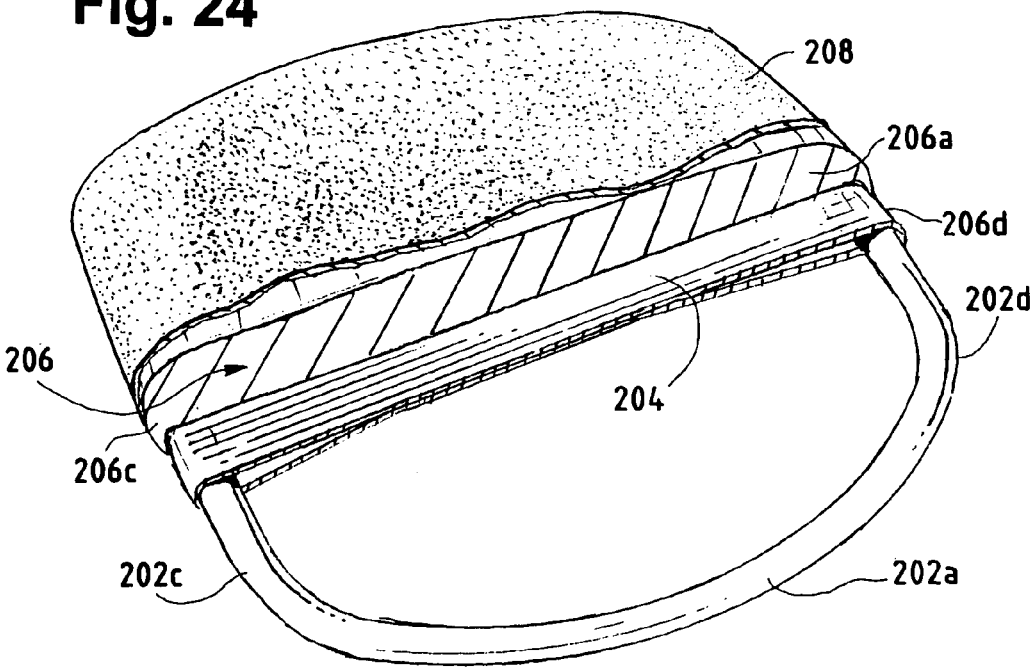
FIG. 24 is a perspective view of the seat of FIG. 21 with a different portion cut away to illustrate various layers of the seat construction.

As illustrated in FIGS. 15 and 16, the clamshell members 36, 38 are closed about the upper segment 54 of the front legs, the panel 56 and most of the portion 52 of the front legs 12 extending upward beyond the seat 16. The flange 96 of the rear clamshell member 38 engages the upper segment 54 and the portion 52 of the front legs 12. The flange 88 of the front clamshell member 36 complements and overlies the flange 96 of the rear clamshell member 38. The holes 90, 98 align and a conventional fastener, such as a screw, rivet, etc., extends through the aligned holes 90, 98 into holes in the upper segment 54 and the portion 52 of the front legs 12 to secure the clamshell members 36, 38 together and to the chair 10. The design of the clamshell members causes the support surface 24 to angle forward relative to the portions 52 of the rear legs 14 extending above the seat 16. The relative angle can be in the preferred range of 5–10° inward. The clamshell members can be made from any material providing suitable support strength, such as molded plastic ABS ⅛ inch thick nominal.

Referring to FIGS. 15 and 16, the foam pad 40 of the backrest 18 is in the form of a sleeve that is fitted over the clamshell members 36, 38 with the sleeve opening toward the seat 16. The foam sleeve 40 is molded to have differing thicknesses at predetermined regions. For example, in the preferred foam sleeve 40, front regions 40*a*, 40*b* are thicker than the rear region 40*c* and the side region 40*d* (i.e., the region that extends about the flange 88 of the front clamshell member 36). The lower portions of the side regions 40*d* are thinner than the remainder of side portions so that the portions 52 of the front legs 14 above the seat 16 can extend from the backrest 18 without causing the overall width of the chair 10 to be so much that the chair cannot be ganged flush to an adjacent chair.

The foam sleeve 40 has a laterally extending slit 100 located approximately one third of the distance down from the top of the chair 10 and centered laterally. The front regions 40*a*, 40*b* located above and below the slit 100 have a vertical convex shape. The thickness of the front regions 40*a*, 40*b* are coordinated with the concave contour of the wall 86 of the front clamshell member 36 so that contour of the backrest is generally flat in the lateral direction. The foam sleeve can be made from two molded pieces (front and back) secured together. The foam sleeve also can be molded from material providing the desired density, which, in the preferred embodiment, is 3.5 pounds per cubic foot.

The cover 42 of the backrest 18 is in the form of a sleeve that is fitted over the foam sleeve 40 in a snug fashion with the sleeve opening toward the seat 16. The opening is closed about the foam sleeve 40 and the front and rear clamshell members 36, 38 in a secure manner, such as with conventional stitching. The cover 42 includes a portion that is designed to fit into the slit 100 of the foam sleeve 40 and to be secured to the front clamshell member 36. More specifically, the cover 42 includes a tail portion 102 that is tucked into the slit 100 and affixed to the wall 86 of the front clamshell member 36. The tail portion 102 can be affixed using glue or any conventional fastener, such as staples 104.

To install the cover 42, the cover's top portion is fitted over the foam sleeve 40 above the slit 100, and then, the tail portion 102 of the cover 42 is inserted into the slit 100 and secured to the wall 86 of the front clamshell member 36 through the slit 100. Next, the remainder of the cover 42 is fitted over the remainder of the foam sleeve 40. Finally, the opening of the cover 42 is closed around the bottom opening of the foam sleeve 40 and the bottom of the front and rear clamshell members 36, 38, which can be done by stitching the opening closed or using other types of conventional fasteners, such as staples.

As illustrated in FIGS. 1, 2 and 8–10, the chair 10 includes a front cover 106 at the front legs 12. The front cover 106 fits over the front legs 12, the first transverse frame member 44 and the short frame members 46, all located below the seat 16. More specifically, the front cover 106 includes a front wall 106*a*, an inner wall 106*b* and three outer walls 106*c*, 106*d*, 106*e*. The inner wall 106*b* and two of the outer side walls 106*d*, 106*e* define a pair of side channels 108, and the inner wall 106*b* and the other outer side wall 106*c* define an upper channel 110. The side channels 108 include a narrow portion 108*a* that receives the lower portion of the front legs 12 and a gradually widening portion 108*b* to accommodate receiving the short frame members 46 at the other portion of the front legs 12. The upper channel 110 receives the first transverse frame member 44. The upper outer wall 106*c* and each of the other outer walls 106*d*, 106*e* are spaced from one another at the corners 114 to provide corner relief to accommodate the juncture between the first transverse frame member 44 and the front legs 12. The front cover 106 is mounted to the front legs 12 using a number of conventional fasteners 116, such as screw/nut combinations, rivets, etc. The front cover 106 protects the frame from damage and can be made from any material having suitable strength, such as ABS ⅛-inch thick nominal, to provide protection.

Referring to FIGS. 1 and 11–14, the chair 10 includes a rear cover 118 at the rear legs 14. The rear cover 118 covers the second and third transverse frame members 48, 50 extending between the rear legs 14 and a portion of the rear legs 12, all located below the seat 16. More specifically, the rear cover 118 includes a rear wall 118*a*, top wall 118*b*, bottom wall 118*c*, upper side walls 118*d*, 118*e* and lower side walls 118*f*, 118*g*. The upper wall 118*b* fits over the third transverse frame member 50 and is separated from the upper side walls 118*d*, 118*e* at the corners 120 to provide corner relief to accommodate the juncture between the third transverse frame member 50 and the rear legs 14. The lower side walls 118*f*, 118*g* are spaced laterally outward from their respective upper sidewalls 118*d*, 118*e*, which defines a gap 122 on each side of the rear cover 118. The gaps 122 allow the rear legs 14 to extend out of the rear cover 118. That is, the upper side wall 118*d*, 118*e* extend along the inside of the rear legs 14, and the lower side walls 118*f*, 118*g* extend along the outside of the rear legs 14. The bottom wall 118*c* and the lower side walls 118*f*, 118*g* form a pair of channels 124 that receive a small segment of the rear legs 14. The rear wall 118*a* includes a number of spaced elongated ribs 126 projecting from the rear of the cover 118. The rear cover 118 can be used as a footrest and the ribs 26 aid in preventing one's feet from sliding around on the rear cover 118. The rear cover 118 is mounted to the rear legs 14 and the third transverse frame member 50 using a number of conventional fasteners 128, such as screw/nut combinations, rivets, etc. The rear cover 118 protects the frame from damage and can be made from any material having suitable strength, such as ABS ⅛-inch thick nominal, to provide protection.

The chair 10 also can be fitted with inter-brackets 130 used to gang chairs together in a row. The inter-brackets 130 are affixed to the outside of the front legs 12 and cooperate with corresponding inter-brackets on adjacent chairs. One side of the chair would have brackets of a female style with a keyway, and the other side would have a male style with a projection terminating with an enlarged end portion that is inserted into the keyway and slid in the keyway to secure the interconnection. The inter-brackets 130 also can be used to attach accessories, such as armrests, to the chairs and in between chairs affixed in rows. The armrests also can include cup holders.

Referring to FIGS. 21–24, there is illustrated another seat 200 for a folding chair embodying features of the present invention. The seat 200 provides a thin profile that promotes a lightweight, compact seat with an enhanced suspension system for comfort. As a result, a chair can provide the benefits of the suspension system without sacrificing storage space.

The seat 200 has a rigid frame 202 to support the suspension system, which includes top and bottom layers of an elastic web 204, a foam pad 206 and a cover 208. More specifically, the frame 202 has a generally rectangular shape with a slightly arcuate front member 202*a*, a slightly arcuate rear member 202*b*, and a pair of generally linear side members 202*c*, 202*d*. The frame 202 preferably has a lightweight, strong construction that is achieved using a hollow tubular construction for the members. The preferred tubular members can be made from any suitable material and characteristics, such as metal or plastic, that provides sufficient strength. One such material would be ⅝–14 gauge EW.

The frame 202 can consist of two generally U-shaped components that are assembled together. For example, one U-shaped component can consist of the front member 202*a* and half of the side members 202*c*, 202*d*, and the other U-shaped component can consist of the rear member 202*b* and the other half of the side members 202*c*, 202*d*. Additionally, end portions 210 of the half side members 202*c*, 202*d* can have a reduced diameter, and when inserted into the other half of the side member of the other U-shaped component, the friction fit between them holds the frame 202 together.

The arcuate front and rear members 202*a*, 202*b* preferably have the same radius of curvature which, for example, can be 19.25 inches. The side members 202*c*, 202*d* adjacent the front member 202*a* includes a slight downward bend 212 to slightly lower the front member 202*a* of the seat 200 relative to the rear member 202*b* and the remaining portions of the side members 202*c*, 202*d*. For example, the bend could lower the lowest portion of the front member 202*a* approximately 1 to 2 inches. Lowering the front member 202*a* provides relief for the back of an occupant's legs, thereby facilitating comfort.

Each side member 202*c*, 202*d* also includes a pair of inward projecting tabs 214 used to mount the seat 200 to a chair. Each tab 214 defines an aperture 216 that is used to attach a bracket (described infra) that, in turn, attaches the seat 200 to a chair.

The elastic web layer 204 is the inner most layer. The elastic web 204 is preferably in the form of sleeve into which the frame 202 is inserted. For example, the front member 202*a* is inserted into the elastic web sleeve 204 first, and then, the elastic web sleeve 204 is closed at the rear member 202*b* either by attaching it to the rear member 202*b* or closing it around the rear member 202*b*. That is, the opening portion of the elastic web sleeve 204 can be attached to the rear member 202*b* with small straps, or the opening portion of the sleeve 204 can be closed, such as with stitching, so that the entire frame 202 is in side the elastic web sleeve 204. The size of the elastic web sleeve 204 and the frame 202 are coordinated such that, when the frame 202 has been inserted into the elastic sleeve 204, the sleeve 204 has the desired amount of pre-tensioning, which is preferably about a 15 percent stretch of the elastic material. The preferred elastic web material is the same as that described supra for the other chair seat suspension system.

The next layer is the foam layer 206, which also preferably is in the form of a sleeve into which the frame 202 fitted with the elastic web sleeve 204 is inserted. For instance, the front member 202*a* is inserted into the foam sleeve 206 first. The foam sleeve 206 can be relatively thin because of the enhanced suspension provided by the frame 202 fitted with the elastic web sleeve 204 and can also have varying thickness. For example, the portion 206*a* of the foam sleeve 206 extending across the top of the seat preferably has a larger thickness than the portions 206*c*, 206*d* along the side members 202*c*, 202*d*, respectively, as well as the portion extending across the bottom of the seat 200. This facilitates a low profile seat, which, in turn, facilitates a low profile chair, which enables more chairs to be stored in give amount of space.

Moreover, the portion 206*a* of the foam sleeve 206 extending across the top of the seat 200 can also have varying thickness to provide enhanced comfort. For example, the portions extending adjacent the side members 206*c*, 206*d* could be thicker to provide enhanced lateral support, and the portion extending adjacent the front member 202*a* could be thinner to provide relief for the back of the legs.

Figure 25:
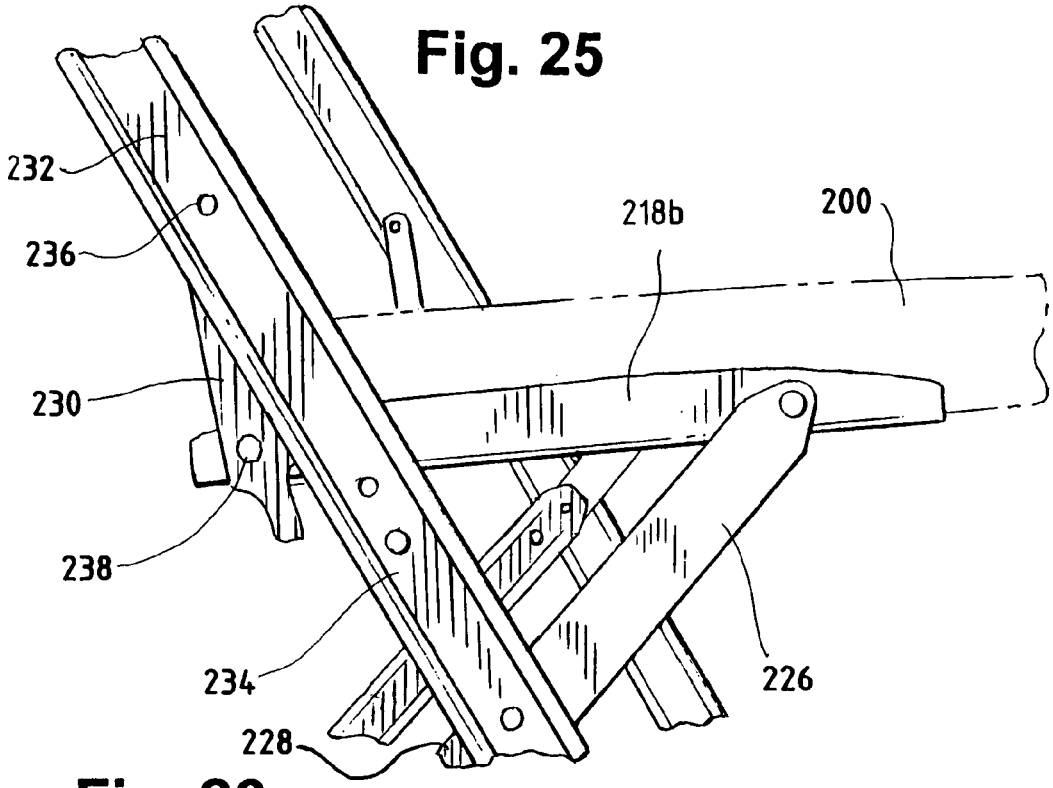
FIG. 25 is a partial perspective view of another folding chair illustrated with the seat of FIG. 21.
Figure 26:
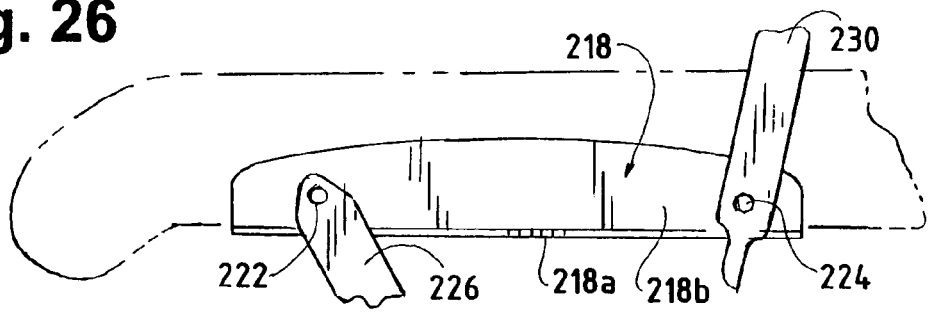
FIG. 26 is a partial side elevational view of a bracket used to mount the seat (shown in phantom) to the folding chair of FIG. 25.
Figure 27:
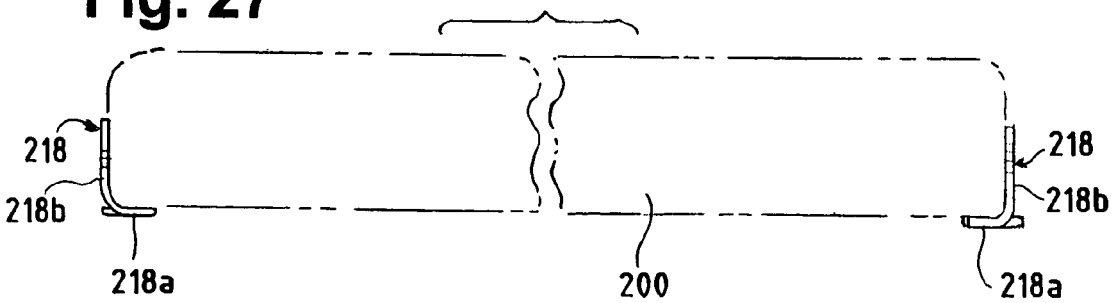
FIG. 27 is a front elevational view of a pair of the brackets of FIG. 26 shown with a seat in phantom.

As mentioned supra, the seat 200 is attached to the folding chair using a bracket. The preferred bracket depends on whether the seat 200 is able to lift up independent of the chair folding. Referring to FIGS. 25–27, there is illustrated a bracket 218 used when the seat 200 is fixed, and in FIGS. 28–30, there is illustrated a bracket 220 that allows the seat 200 to pivot upward independently of the chair folding. The preferred brackets can be made of any suitable material, such as 14 gage steel, that is known to support the desired load.

More specifically, to mount the seat 200 in fixed manner, a pair of the brackets 218 are used, with one mounted along each of the side members 202*c*, 202*d* of the seat frame 202. The bracket 218 has an elongated construction with an L-shaped cross-section defined by an elongated horizontal member 218*a* that attaches to and supports the seat 200 and an elongated vertical member 218*b* that attaches to the chair. The horizontal member 218*a* defines a pair of holes that align with the holes 216 of the tabs 214, and a conventional fastener, such as a screw, bolt/nut combination, etc., extends through the aligned holes and secures the bracket 218 to the seat 200. The vertical member 218*b* also defines a pair of holes 222, 224, each located adjacent opposite ends, to secure the seat to the chair frame.

The hole 222 closer to the front member 202*a* of the seat 200 is used to attach the bracket 218 to an upward extension 226 of a rear leg 228 of the chair frame. The length of the upward extension 226 is coordinated to support the seat 200 in a horizontal orientation for use. The terminal end of the upward extension 226 defines a hole that is aligned with the hole 222 of the bracket 218*a*, and a conventional fastener, such as a bolt/nut combination, rivet, etc., extends through the aligned holes to secure the bracket 218 to the upward extension 226 in manner that allows them to pivot relative to one another so the seat 200 can be pivoted upward to a generally vertical orientation for storage.

The other hole 224 of the vertical member 218*b* attaches to a link member 230 that attaches to an upward extension 232 of the front leg member 234. More specifically, the link member 230 defines a pair of holes, each located adjacent the ends of the link member 230. One hole aligns with a hole in the upward extension 232 of the front leg member 234, and a conventional fastener, such as a bolt/nut combination, rivet, etc., extends through the aligned holes to form a pivotable attachment 236. The other holes aligns with the hole 224 of the vertical member 218*b*, and a conventional fastener, such as a bolt/nut combination, rivet, etc., also extends through the aligned holes to form a pivotable attachment 238. The length of the link member 230 is coordinated to support the seat 200 in a horizontal orientation for use and allow the seat 200 to be pivoted upward as the chair is folded to its storage position. For example, in the use position, the link member 230 extends generally vertical relative to the ground, and in the storage position, the link member 230 extends generally parallel to the front leg member 234. It is also preferred that the brackets 218 be mounted to the chair first, and then, the seat 200 is affixed to the brackets 218.

Figure 28:
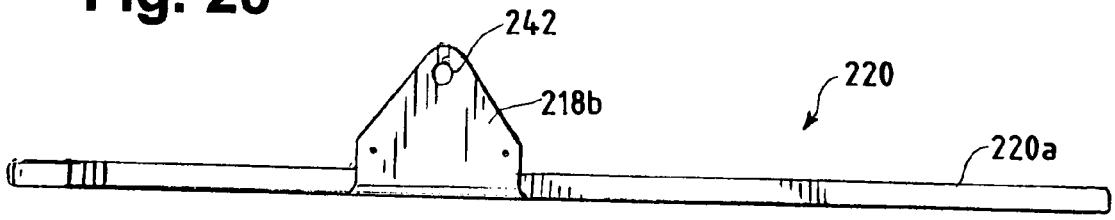
FIG. 28 is a side elevational view of another bracket used to mount the seat of FIG. 21.
Figure 29:
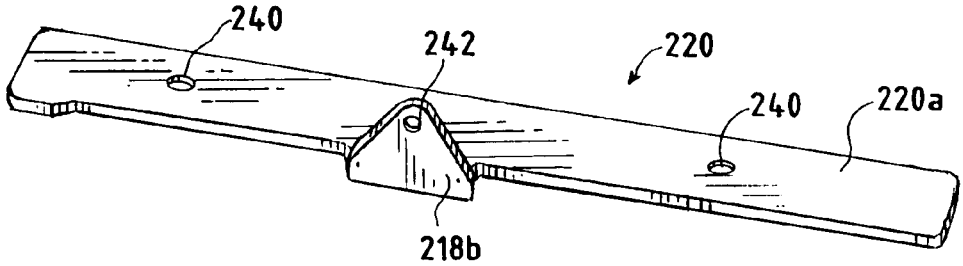
FIG. 29 is a perspective view of the bracket of FIG. 28.
Figure 30:
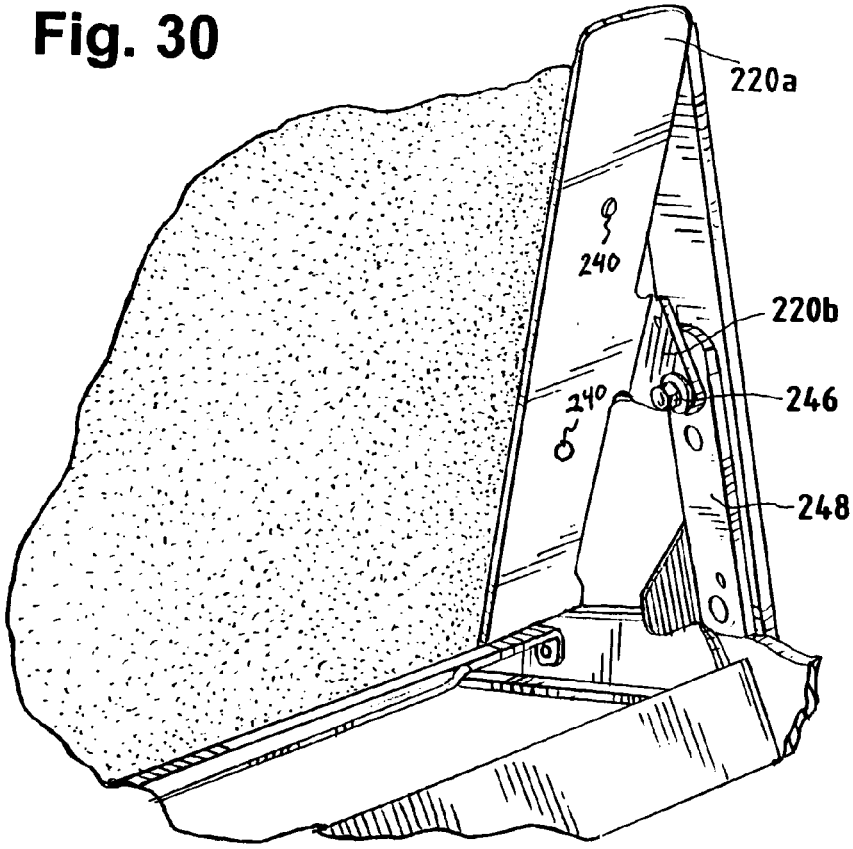
FIG. 30 is a perspective view of the bracket of FIG. 28 mounting the seat of FIG. 27 to another folding chair.

As illustrated in FIGS. 28–30, to mount the seat 200 in pivotable manner, a pair of the brackets 220 are employed, with one mounted along each of the side members 202*c*, 202*d* of the seat frame 202. The bracket 220 has an elongated horizontal member 220*a* that attaches to and supports the seat 200 and a vertical tab 220*b* that attaches to the chair. The horizontal member 220*a* defines a pair of holes that align with the holes 216 of the tabs 214 and a conventional fastener, such as a screw, bolt/nut combination, rivet, etc, extends through the aligned holes and secures the bracket 220 to the seat 200. The vertical tab 220*b* also defines a hole 242 to secure the seat 200 to the chair frame. That is, the hole

242 aligns with a hole in the rear leg 244 of the chair frame, and a conventional fastener, such as a screw, bolt/nut combination, rivet, etc, extends through the aligned holes and secures the bracket 220 to the chair frame with a pivot attachment 246. A spacer 248 is preferably between the vertical tab 220*b* and the rear leg 244. Additionally, the preferred vertical tab 220*b* has a generally triangular configuration with the hole 242 at the distal apex.

It will be understood that various changes in the detail, materials and arrangement of parts and assemblies which have been herein described and illustrated in order to explain the nature of the present invention may be made by those skilled in the art within the principle and scope of the present invention as expressed in the appended claims.

What is claimed is:

1. A chair apparatus a frame having a plurality of frame members, the frame members being moveable between a first position for storage and a second position for use;

a backrest supported by the frame; and a seat supported by the frame and moveable relative to the frame members, the seat comprising a seat support and a first resilient seating layer, the seat support defining an opening and at least a portion of the first resilient seating layer extending over the opening so that the first resilient seating layer is capable of extending below the seat support, the chair apparatus further including a cover extending over at least a portion of the first resilient seating layer, and including a second resilient seating layer extending over at least a portion of the first resilient seating layer, wherein the first resilient seating layer forms a sleeve receiving at least a portion of the seat support a and the second resilient seating layer forms a sleeve receiving at least a portion of the first resilient seating layer and at least a portion of the seat support; and a cover forming a sleeve receiving at least a portion of the first and second resilient seating layers and at least a portion of the seat support.

2. A chair apparatus in accordance with claim 1 wherein the seat further comprises a bottom cover extending over at least a portion of the opening of the seat support.

3. A chair apparatus in accordance with claim 2 wherein the bottom cover defines at least one aperture for air to pass through.

4. A chair apparatus comprising:

a frame having a plurality of frame members, the frame members being moveable between a first position for storage and a second position for use;

a seat supported by the frame; and a backrest supported by the frame and having a backrest support at least partially enclosing at least a portion of the frame, wherein the backrest support comprises at least two shell members that combine to at least partially enclose at least a portion of the frame that supports the backrest, the backrest further comprises a layer of resilient material over at least a portion of one of the two shell members, and a cover over at least a portion of the layer of resilient material and at least a portion of one of the two shell members, wherein the resilient material forms a sleeve that receives at least a portion of the at least two shell members, the cover forms a sleeve that receives at least a portion of the at least two shell members and at least of portion of the layer of resilient material, and wherein the layer of resilient material defines a slit and the cover extends into the slit to cover the resilient material defining the slit.

* * * * *